US006357372B1

(12) United States Patent
Gokan et al.

(10) Patent No.: US 6,357,372 B1
(45) Date of Patent: Mar. 19, 2002

(54) SADDLE TYPE SMALL-SIZED BOAT

(75) Inventors: Yoshitsugu Gokan; Hitoshi Yokotani, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/714,145

(22) Filed: Nov. 17, 2000

(30) Foreign Application Priority Data

Nov. 19, 1999 (JP) ..... 11-329460

(51) Int. Cl.[7] ..... B63H 21/10
(52) U.S. Cl. ..... 114/55.57; 440/88
(58) Field of Search ..... 440/88, 89, 53; 114/55.5

(56) References Cited

U.S. PATENT DOCUMENTS 6,205,987 B1 * 3/2001 Shigedomi et al. ..... 123/583

FOREIGN PATENT DOCUMENTS

JP 10252440 9/1998

* cited by examiner

*Primary Examiner*—Ed Swinehart

(57) ABSTRACT

To make an intake apparatus and the inside of a boat body less likely to be contaminated with oil and to make an electric apparatus less likely to suffer from any trouble. A four-cycle engine having a head cover in which a breather exit is formed is carried in a boat body, and an oil storage portion when the boat is capsized is formed from the head cover. An upper face of the head cover is positioned close to and extends along a ceiling of the boat body, and the breather exit is provided above an upper face of oil stored in the head cover when the boat is capsized. A connection portion of the intake apparatus to a breather pipe is disposed below the breather exit. The head cover has a water drain path formed therein which connects to a plug mounting-dismounting hole and is opened to a peripheral face of the head cover rearwardly of the hole with respect to an advancing direction of the boat body. A water drain flow path is formed at a lowermost end portion of a bearing surface for a plug.

20 Claims, 9 Drawing Sheets

SADDLE TYPE SMALL-SIZED BOAT

BACKGROUND OF THE INVENTION

1. Field of the Invention

This invention relates to a saddle type small-sized boat wherein a four-cycle engine having a head cover is carried in a boat body. More particularly, the present invention relates to the head cover and a cylinder head of the four-cycle engine of the saddle type small-sized boat.

2. Description of Background Art

Conventionally, a small-sized boat as shown in FIGS. 9(*a*) and 9(*b*) is known as a saddle type small-sized boat wherein a four-cycle engine having a head cover is carried in a boat body (Japanese Patent Laid-Open NO. Hei. 10 252440).

FIGS. 9(*a*) and 9(*b*) are front elevational sectional views of the boat. FIG. 9(*a*) shows the boat in an ordinary state and 9(*b*) shows the boat in a capsized state. The surface of the water is designated by the letter H.

As shown in FIG. 9(*a*), the boat 1 includes a four-cycle engine 3 carried in a boat body 2 and further includes a jet pump not shown which is driven by the four-cycle engine 3.

A breather exit 4*a* is provided in a head cover 4 of the engine 3 and is connected to an intake apparatus 6 by a breather pipe 5.

Accordingly, with the engine 3 having such a construction as just described, blowby gas leaking out into the head cover 4 is allowed to flow back and be burnt.

Further, a hole (not shown) through which a plug (ignition plug) is to be mounted and dismounted is formed in the head cover 4, and a bearing surface (not shown) for a plug is formed on a cylinder head.

Since a saddle type small-sized boat of the type described is used principally for leisure, it is capsized frequently, and water sometimes enters the boat body.

In such a situation as just described, the conventional saddle type small-sized boat as illustrated in FIGS. 9(*a*) and 9(*b*) and as described above has the following problems.

If the boat 1 is capsized as shown in (*b*) of FIG. 9, then oil in the engine 3 flows downwardly (toward the head cover 4). However, the oil cannot be stored sufficiently by the conventional head cover 4, and there is the possibility that the oil may flow from the breather exit 4*a* through the breather pipe 5 into the intake apparatus 6, resulting in contamination of the intake apparatus 6 with the oil. Further, if the oil flows out from the intake apparatus 6, then there is the possibility that the inside of the boat body 2 may also be contaminated with the oil.

With the conventional saddle type small-sized boat as illustrated in FIGS. 9(*a*) and 9(*b*), if water entering the boat body splashes on the head cover 4, then the water stays in the plug mounting-dismounting hole and sometimes causes trouble with an electric apparatus.

Particularly when the saddle type small-sized boat is turned back as shown in FIG. 9(*a*) by a user after it is capsized as shown in FIG. 9(*b*), water splashes by a large amount on the head cover 4, and the water is liable to stay in the plug mounting-dismounting hole and cause trouble with the electric apparatus.

SUMMARY AND OBJECTS OF THE INVENTION

It is a first object of the present invention to solve the problems described above and provide a saddle type small-sized boat wherein an intake apparatus and the inside of a boat body is less likely to be contaminated with oil.

It is a second object of the present invention to solve the problems described above and provide a saddle type small-sized boat which is less likely to suffer from causing trouble to an electric apparatus.

To attain the first object of the present invention, a saddle type small-sized boat is provided wherein a four-cycle engine having a head cover in which a breather exit is formed is carried in a boat body and the head over forms an oil storage portion when the boat is capsized. The oil storage portion is configured such that an upper face of the head cover is positioned close to a ceiling of the boat body and extends along the ceiling. In addition, the breather exit is provided above an upper face of any oil that is stored in the head cover when the boat is capsized.

A saddle type small-sized boat of the present invention is directed to a four-cycle engine having a head cover in which a breather exit is connected to an intake apparatus by a breather pipe, and a connection portion of the breather pipe to the intake apparatus is positioned below the breather exit.

A saddle type small-sized boat according to the present invention provides a breather exit on an upstream side with respect to a turning direction when the boat is turned back after capsized.

A saddle type small-sized boat according to the present invention provides a four-cycle engine having a head cover in which a plug mounting-dismounting hole is formed and the head cover has a water drain path formed therein which connects to the plug mounting-dismounting hole and is opened to a peripheral face of the head cover rearwardly of the hole with respect to an advancing direction of the boat body.

A saddle type small-sized boat according to the present invention is provided wherein the four-cycle engine is a DOHC engine having intake and exhaust camshafts independent of each other, and the water drain path of the head cover extends in the rear of a cam cover portion of the head cover which covers cam portions of the camshafts with respect to the advancing direction of the boat body and is opened to a peripheral face of the head cover.

A saddle type small-sized boat according to the present invention is provided wherein an upper face of a cylinder head of the engine is inclined as viewed from the front of the boat body, and the water drain path is opened downwardly in a direction of the inclination.

A saddle type small-sized boat according to the present invention is provided wherein the water drain path is opened to a downstream side of the plug mounting-dismounting hole with respect to a turning direction when the boat body is turned back after capsized.

A saddle type small-sized boat according to the present invention is provided with an engine having a plug mounting-dismounting hole and a plug bearing surface which are inclined as viewed from the front of a boat body and includes a water drain flow path that is formed at lowermost end portions of the plug mounting-dismounting hole and the plug bearing surface.

A saddle type small-sized boat according to the present invention is provided with water drain flow path on the downstream side of the plug mounting-dismounting hole and the plug bearing surface with respect to a turning direction when the boat is turned back after the boat has capsized.

It is to be noted that the turning direction when the boat is turned back after the boat has capsized is indicated in a user's manual, on the boat body and so forth.

A saddle type small-sized boat provides a head cover for a four-cycle engine with a breather exit formed in the boat body. An oil storage portion is provided when the boat is capsized wherein oil flowing downwardly (toward the head cover) when the boat is capsized is stored by the head cover.

Since the upper face of the head cover is positioned close to the ceiling of the boat body and extends along the ceiling, the containing capacity of the head cover can be increased, and the stored amount of the oil by the head cover is assured sufficiently.

Further, since the breather exit described above is provided above the upper face of the oil stored in the head cover when the boat is capsized, such a situation wherein the oil flows out through the breather exit is less likely to occur.

Accordingly, with the saddle type small-sized boat a situation where the oil flows out from the head cover when the saddle type small-sized boat is capsized is less likely to occur. As a result, an advantage occurs in that an intake apparatus and the inside of the boat body are less likely to be contaminated with the oil. In addition, since the containing capacity of the head cover can be increased, the breathing performance is augmented.

In other words, with the saddle type small-sized boat according to the present invention a situation occurs where the oil flowing out is less likely to occur and simultaneously the breathing performance is augmented.

With the saddle type small-sized boat according to the present invention, since a breather exit of the saddle type small-sized boat with the four-cycle engine having the head cover is provided in which the breather exit is formed in the boat body and is connected to the intake apparatus by the breather pipe, blowby gas leaking out into the head cover is allowed to be flow back and be burnt.

Further, since the connection portion of the intake apparatus to the breather pipe is positioned below the breather exit described above, when the boat is capsized, the connection portion of the intake apparatus to the breather pipe is positioned above the breather exit described above.

Accordingly, when the boat is capsized, the oil is less likely to flow from the breather exit of the head cover to the intake apparatus, and as a result, an effect that the intake apparatus and the inside of the boat body are less likely to be contaminated with the oil is attained.

With the saddle type small-sized boat according to the present invention, since the breather exit in the saddle type small boat is provided on the upstream side with respect to the turning direction when the boat is turned back after the boat has capsized, a situation wherein the oil flows out through the breather exit when the boat is turned back after capsized does not occur.

Accordingly, when the boat is turned back after the boat has capsized, the intake apparatus and the inside of the boat body are prevented from being contaminated with the oil.

With the saddle type small-sized boat according to the present invention, since the head cover of the saddle type small-sized boat with the four-cycle engine having the head cover in which the plug mounting-dismounting hole is formed is carried in the boat body and is formed therein with the water drain path which is connected to the plug mounting-dismounting hole and is opened to the peripheral face of the head cover rearwardly of the hole with respect to the advancing direction of the boat body, water is less liable to stay in the plug mounting-dismounting hole in the head cover as described below.

In particular, a saddle type small-sized boat of this type is inclined during operation thereof such that the forward portion thereof in the advancing direction is directed upwardly and the rear portion is directed downwardly.

Further, with the saddle type small-sized boat according to the present invention, since the water drain path is connected to the plug mounting-dismounting hole and is opened to the peripheral face of the head cover rearwardly of the hole with respect to the advancing direction of the boat body, water is less liable to stay in the plug mounting-dismounting hole. Accordingly, an electric apparatus is less likely to suffer from any trouble.

With the saddle type small-sized boat according to the present invention, since the four-cycle engine in the saddle type small-sized boat is a DOHC engine having intake and exhaust camshafts independent of each other and the water drain path of the head cover extends to the rear of the cam cover portion of the head cover which covers the cam portions of the camshafts and is opened to the peripheral face of the head cover, the water drain path of the DOHC engine which has the intake and exhaust camshafts independent of each other can be formed efficiently.

With the saddle type small-sized boat according to the present invention, since the upper face of the cylinder head of the engine in the saddle type small-sized boat is inclined as viewed from the front of the boat body and the water drain path is opened downwardly in the inclination direction of the upper face, water is much less likely to stay in the plug mounting-dismounting hole, and accordingly, the electric apparatus is much less likely to suffer from any trouble.

With the saddle type small-sized boat according to the present invention, since the water drain path in the saddle type small-sized boat is opened toward the downstream side of the plug mounting-dismounting hole with respect to the turning direction when the boat is turned back after the boat has capsized, water is much less likely to stay in the plug mounting-dismounting hole as described below, and accordingly, an electric apparatus is much less likely to suffer from any trouble.

In particular, when the boat is turned back by the user after the boat has capsized, a large amount of water sometimes splashes on the head cover. With the saddle type small-sized boat according to the present invention, however, since the water drain path is opened toward the downstream side of the plug mounting-dismounting hole with respect to the turning direction when the boat is turned back after the boat has capsized, even if a large amount of water splashes on the head cover in the process wherein the boat is turned back, the water is discharged with certainty from the plug mounting-dismounting hole past the water drain path.

Accordingly, when the boat is turned back after the boat has capsized, water is less likely to stay in the plug mounting-dismounting hole, and accordingly, an electric apparatus is less likely to suffer from any trouble.

With the saddle type small-sized boat according to the present invention, since the water drain flow path is formed at the lowermost end portions of the plug mounting-dismounting hole and the plug bearing surface of the saddle type small-sized boat and the engine having the plug mounting-dismounting hole and the plug bearing surface which are inclined as viewed from the front of the boat body is carried in the boat body, water does not stay around the plug mounting-dismounting hole and the plug bearing surface, and an electric apparatus is less likely to suffer from any trouble.

With the saddle type small-sized boat according to the present invention, since the water drain flow path in the saddle type small-sized boat is provided on the downstream side of the plug mounting-dismounting hole and the plug bearing surface with respect to the turning direction when the boat is turned back after the boat has capsized, even if a large amount of water splashes around the plug mounting-dismounting hole and the plug bearing surface in the process wherein the boat is turned back, the water is discharged with certainty past the water drain flow path. Accordingly, water is less liable to stay around the plug mounting-dismounting hole and the plug bearing surface after the boat is turned back after capsized, and accordingly, the electric apparatus is less likely to suffer from a trouble.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
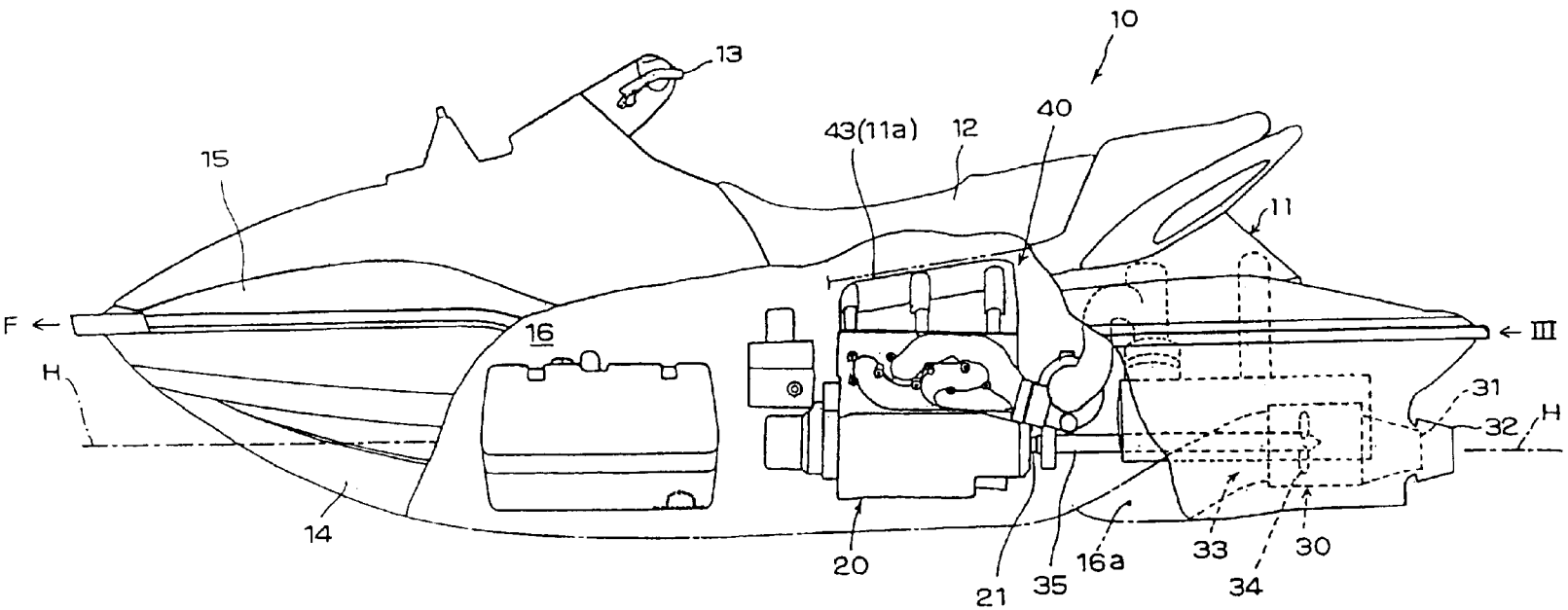
FIG. 1 is a schematic side elevational view, partly broken, showing an embodiment of a saddle type small-sized boat according to the present invention.
Figure 2:
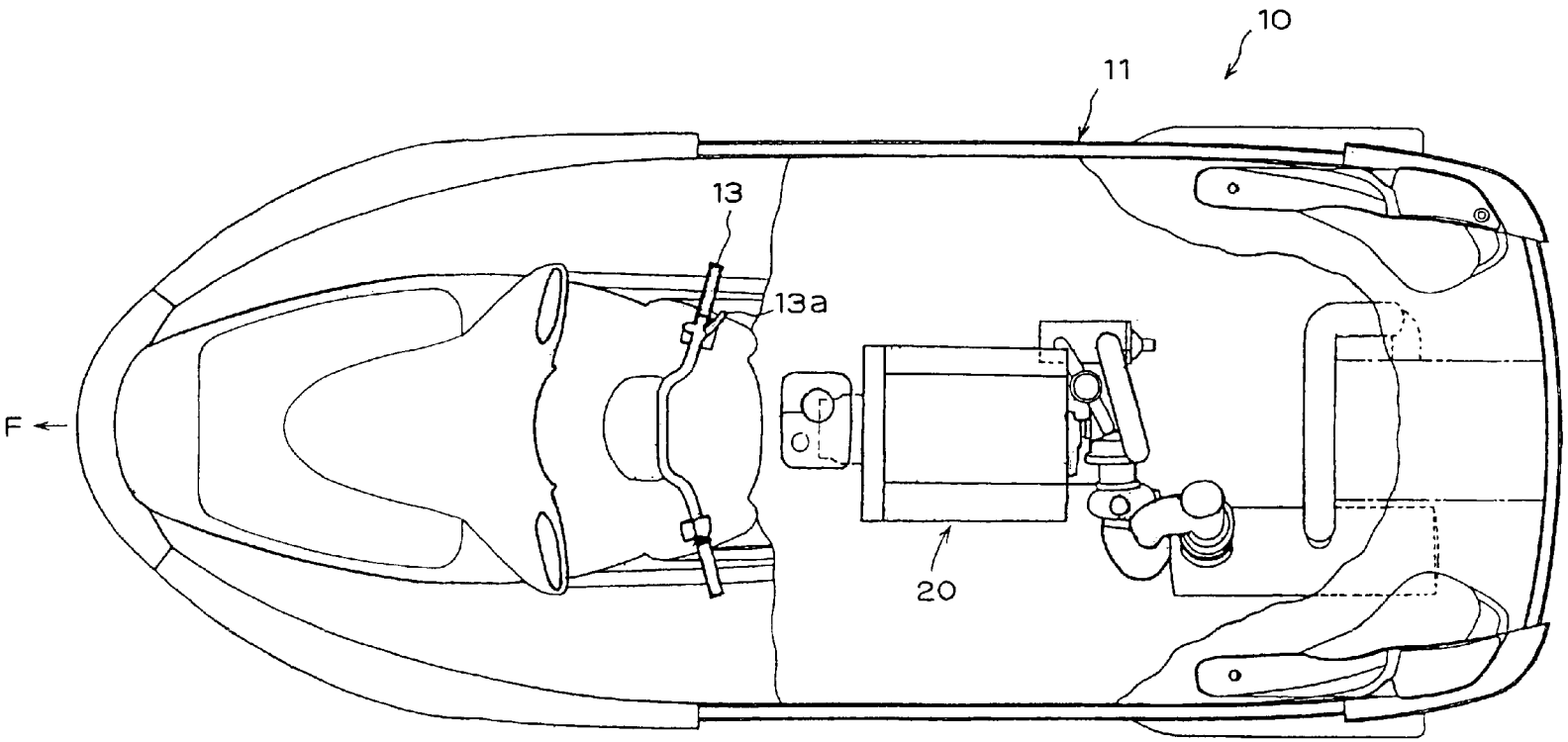
FIG. 2 is a top plan view of the small-sized boat.
Figure 3:
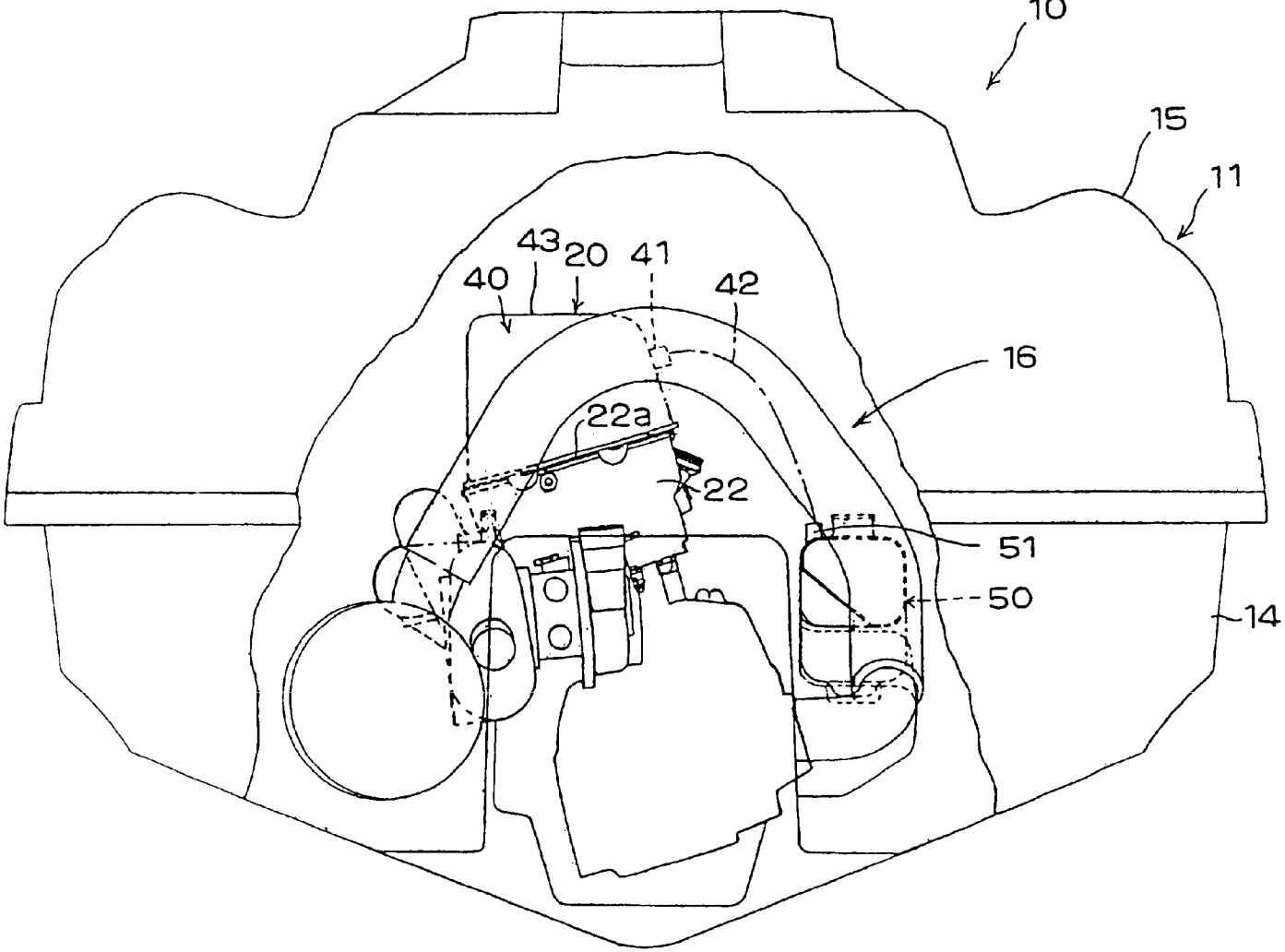
FIG. 3 is a rear elevational view, partly broken, of the small-sized boat, as viewed in a direction of an arrow mark III in FIG. 1.
Figure 4:
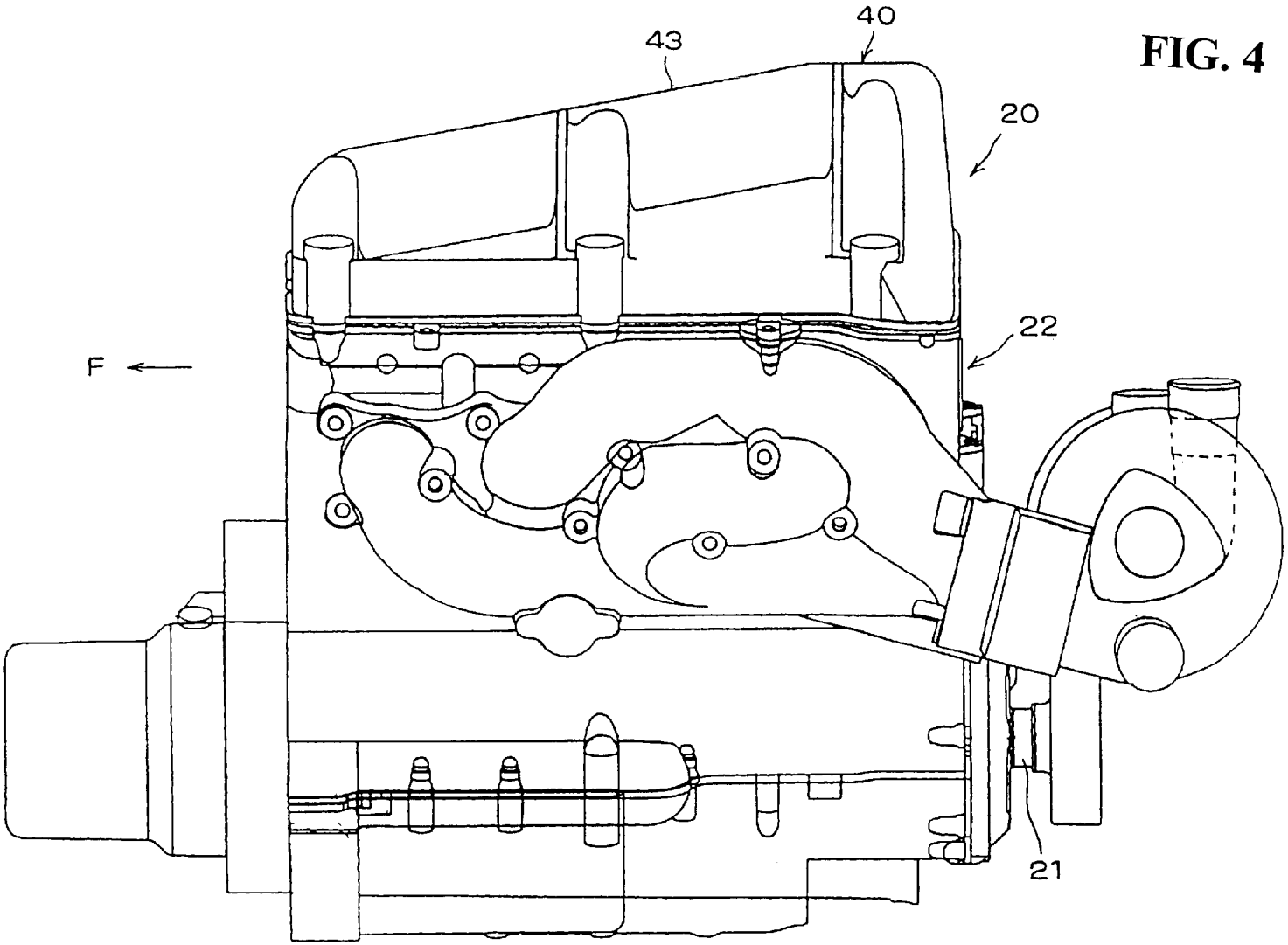
FIG. 4 is a schematic side elevational view of an engine 20.

In the following, an embodiment of the present invention is described with reference to the drawings. As shown in FIGS. 1 to 3 (principally in FIG. 1), the saddle type small-sized boat 10 of the present embodiment can be steered by a steering handle bar 13 with a throttle lever gripped by a passenger seated on a seat 12 on a boat body 11.

The boat body 11 has a floating body structure wherein a lower hull panel 14 and upper hull panel 15 are jointed together with a space 16 formed therebetween. In the space 16, an engine 20 is placed on the lower hull panel 14, and a jet pump 30 serving as propelling means driven by the engine 20 is provided at a rear portion of the lowerhull panel 14.

The jet pump 30 has a flow path 33 extending from a intake 16*a* opened to the bottom of the boat to a jet 31 opened to a rear end of the boat body and a nozzle 32, and an impeller 34 disposed in the flow path 33. A shaft 35 of the impeller 34 is connected to an output power shaft 21 of the engine 20. Accordingly, if the impeller 34 is driven to rotate by the engine 20, then water taken in through the intake 16*a* is jetted from the jet 31 past the nozzle 32, whereby the boat body 11 is propelled. The driving speed of the engine 20, that is, the propelling force by the jet pump 30, is controlled by a revolving operation of a throttle lever 13*a* (refer to FIG. 2) of the steering handle bar 13 described above. The nozzle 32 is associated with the steering handle bar 13 by a control wire not shown and is controlled to be turned by an operation of the handle bar 13, whereby the advancing direction can be changed.

The engine 20 is a DOHC straight four-cylinder four-cycle engine, and intake and exhaust camshafts 23 and 24 (refer to FIG. 5) are provided independent of each other and a head cover 40 which covers a cylinder head 22 is provided on the cylinder head 22.

Figure 6:
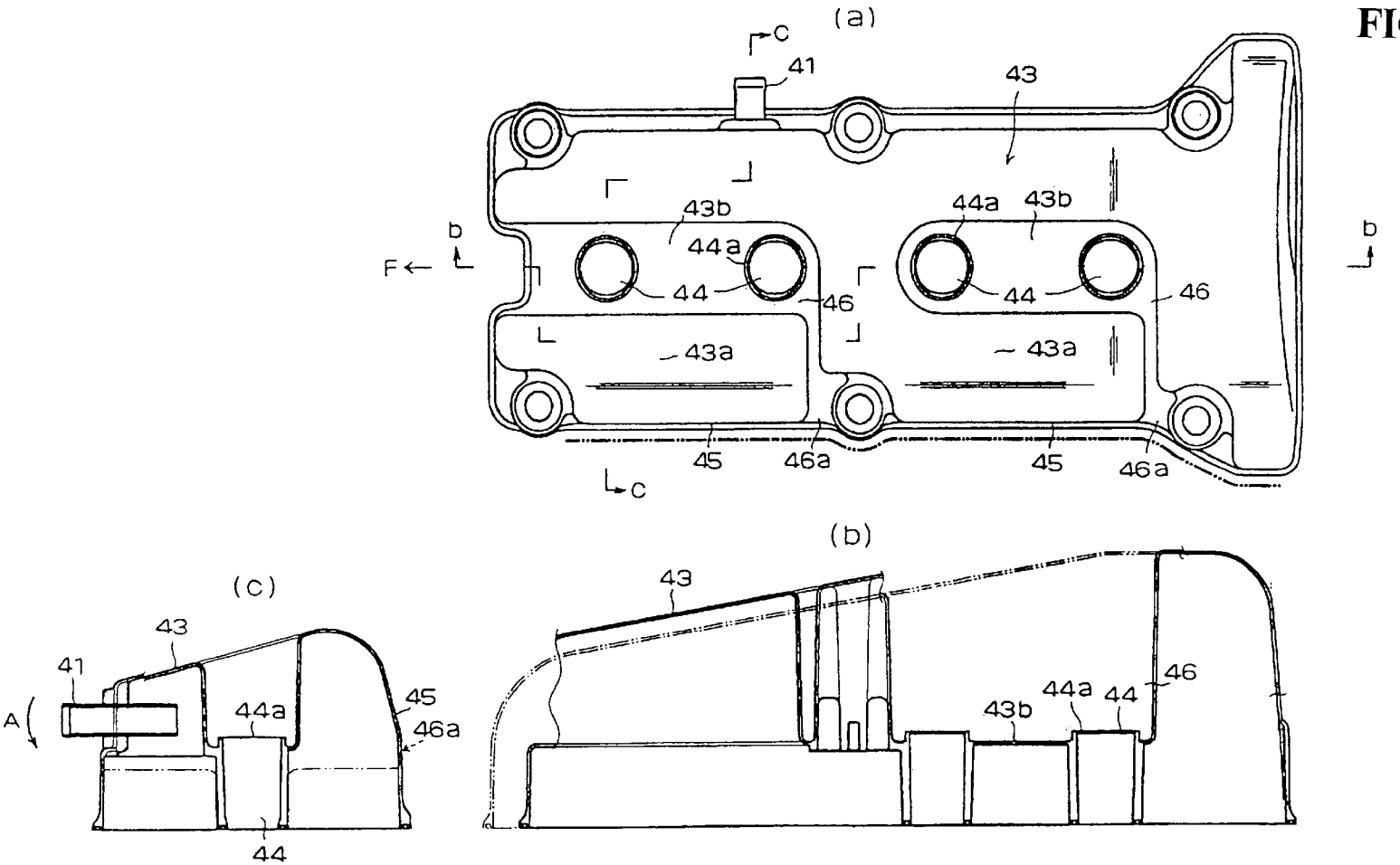
FIGS. 6(*a*) to 6(*c*) are views showing a head cover of the engine 20, and wherein 6(*a*) is a top plan view of the head cover illustrated in FIG. 4, 6(*b*) is a sectional view taken along line b—b of 6(*a*) of FIG. 6(*c*) is a sectional view taken along line c—c of FIG. 6(*a*)

As shown in FIGS. 3 and 6, a breather exit 41 in the form of a pipe is provided in the head cover 40 and is connected to an intake apparatus 50 by a breather pipe 42, indicated by an alternate long and short dash line in FIG. 3. A connection portion 51 of the breather pipe 42, and the intake apparatus 50 is illustrated in FIG. 3. The connection portion 51 is positioned lower than the breather exit 41.

Figure 5:
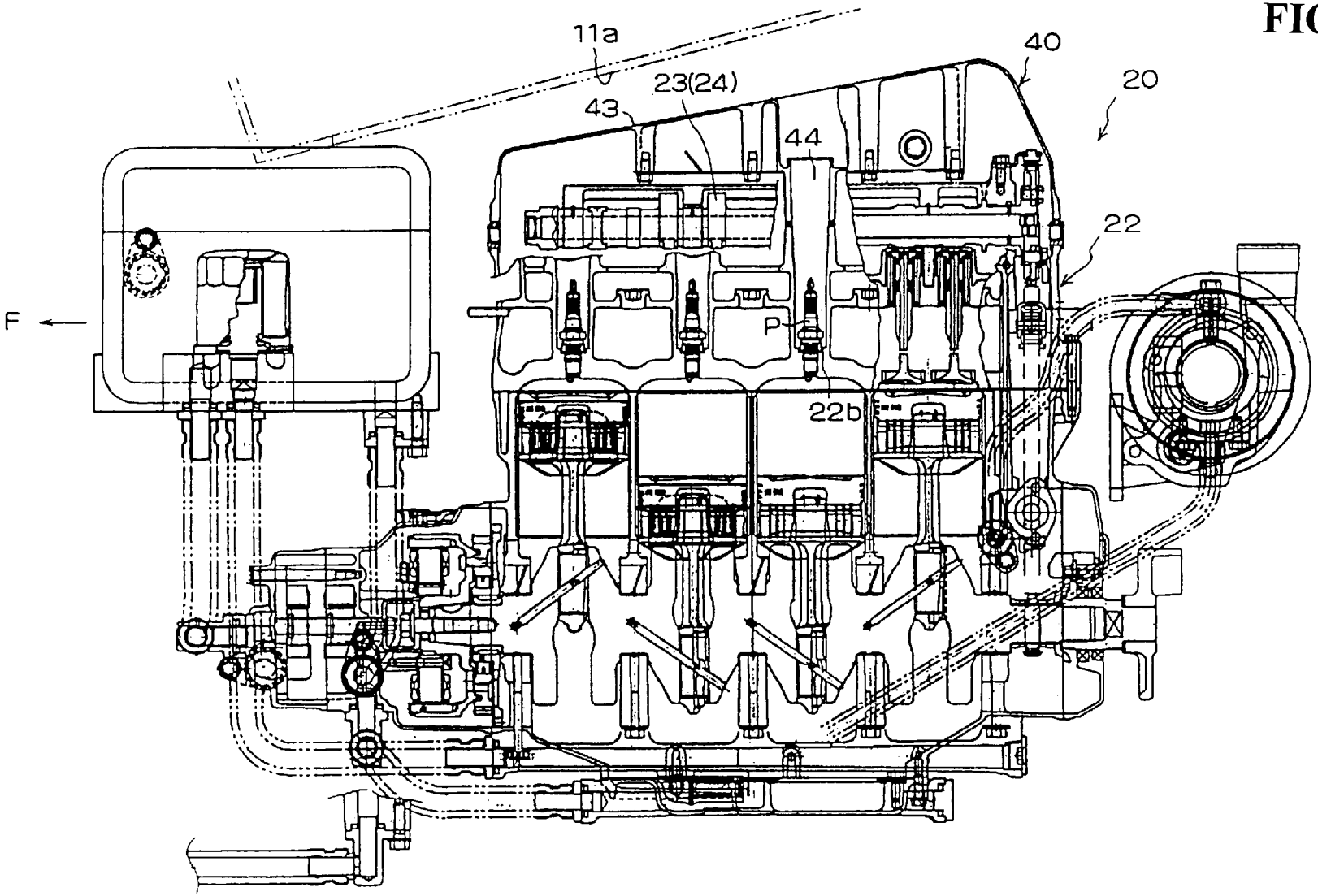
FIG. 5 is a sectional view, partly broken, of the engine 20.

The head cover 40 in the present embodiment forms an oil storage portion when the boat 10 is capsized (refer to FIG. 7) and is constructed such that an upper face 43 thereof is positioned close to a ceiling 11*a* of the boat body 11 and extends along the ceiling 11*a* as shown in FIGS. 1, 3, and 5. The breather exit 41 is provided above an upper face O1 (refer to FIG. 7) of oil O stored in the head cover 40 when the boat is capsized. Further, the breather exit 41 is provided on the upstream side of the upper face O1 of the oil with respect to a turning direction (an arrow marking the A direction in FIG. 7) when the boat is turned back after the boat has capsized. It is to be noted that the turning direction of the boat 10 when it is turned back after the boat has capsized is described in its user's manual and indicated also on the boat body 11.

As shown principally in FIGS. 6(*a*) to 6(*c*), the head cover 40 has formed therein a hole 44 through which a plug P (refer to FIG. 5) is to be mounted and dismounted, and a water drain path 46 which is opened to a peripheral face 45 of the head cover 40 rearwardly of the hole 44 with respect to an advancing direction F of the boat body 11. The opening portion 46*a* of the water drain path 46 is illustrated in FIGS. 6(*a*) to 6(*c*).

Referring to 6(*a*), a cam cover portion 43*a* covers cam portions of the intake and exhaust camshafts 23 and 24 (refer to FIG. 5) described hereinabove, and the water drain path 46 extends to the rear of the cam cover portion 43*a* with respect to the advancing direction F of the boat body and is opened (46*a*) to the peripheral face 45 of the head over.

As shown in FIG. 3, an upper face 22*a* of the cylinder head 22 of the engine 20 is inclined as viewed from the front of the boat body 11 (inclined leftwardly downwardly as viewed from the rear (FIG. 3)), and the water drain path 46 is opened (46*a*) downwardly in the inclination direction of the upper face 22*a*, leftwardly in FIG. 3 and downwardly in FIG. 6(*a*). In particular, an upper face 44*a* (refer to FIGS. 6(*a*) to 6(*c*)) of the plug mounting-dismounting hole 44 of the head cover 40 and a face 43*b* around the upper face 44*a* extend substantially in parallel to the upper face 22*a* of the cylinder head 22 and is inclined as viewed from the front of the boat body 11 (inclined leftwardly downwardly as viewed from the rear (FIG. 3)), and the water drain path 46 described above is opened (46*a*) downwardly in the inclination direction (leftwardly in FIG. 3 and downwardly in FIG. 6(*a*).

Figure 7:
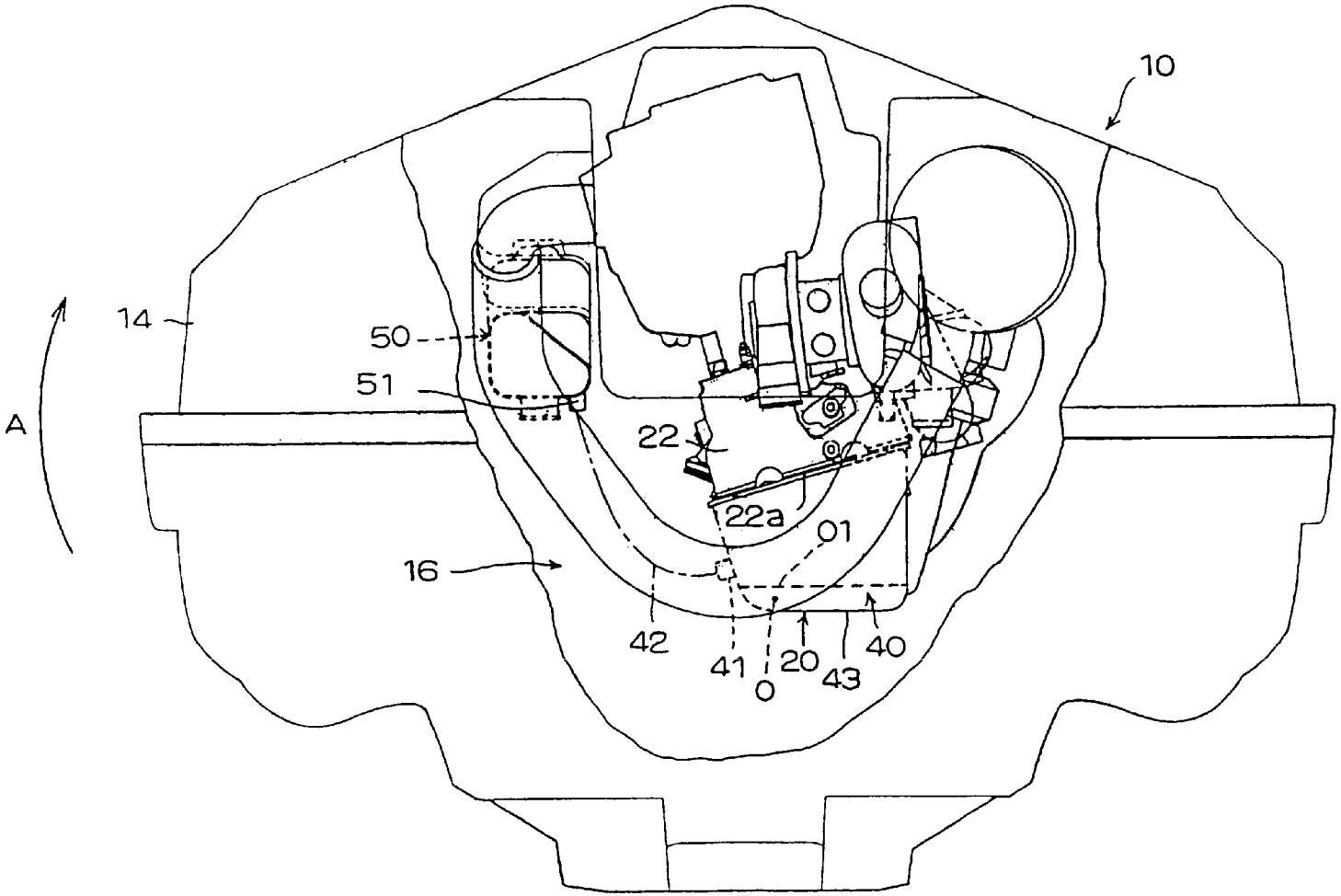
FIG. 7 is a rear elevational view, partly broken, showing a capsized state of the boat 10.

Further, the water drain path 46 is opened downwardly from the plug mounting-dismounting hole 44 with respect to the turning direction (a direction indicated by an arrow mark A in FIG. 7 of FIG. 6(*c*)) when the boat is turned back after the boat has capsized.

Figure 8:
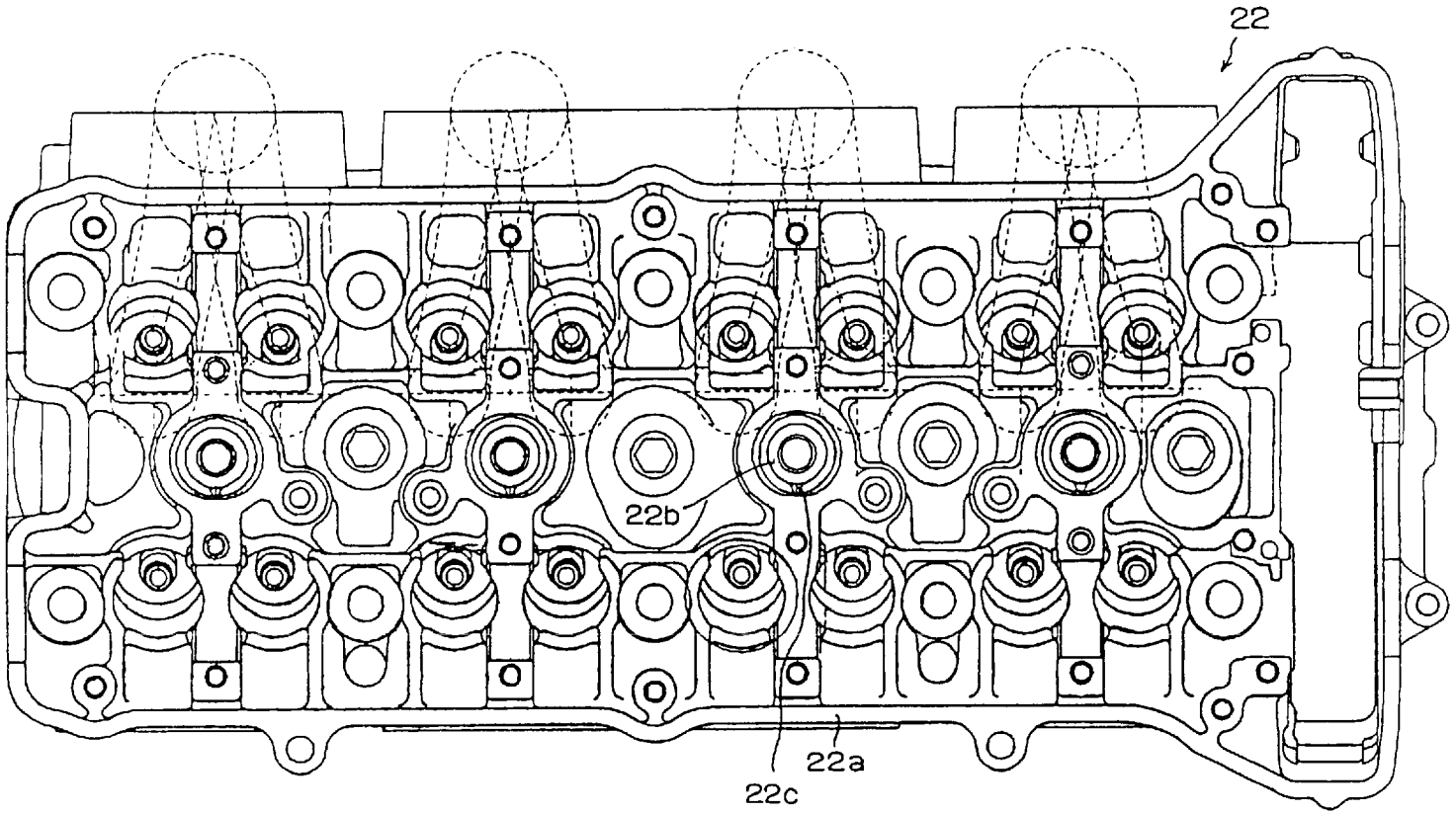
FIG. 8 is a top plan view of a cylinder head 22.
Figure 9A:
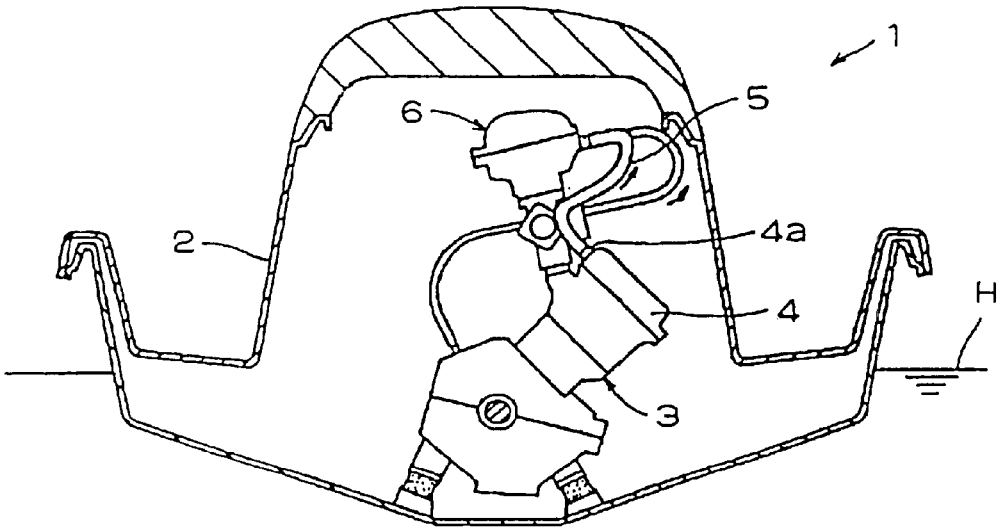
FIGS. 9(*a*) and 9(*b*) are explanatory views of the prior art.
Figure 9B:
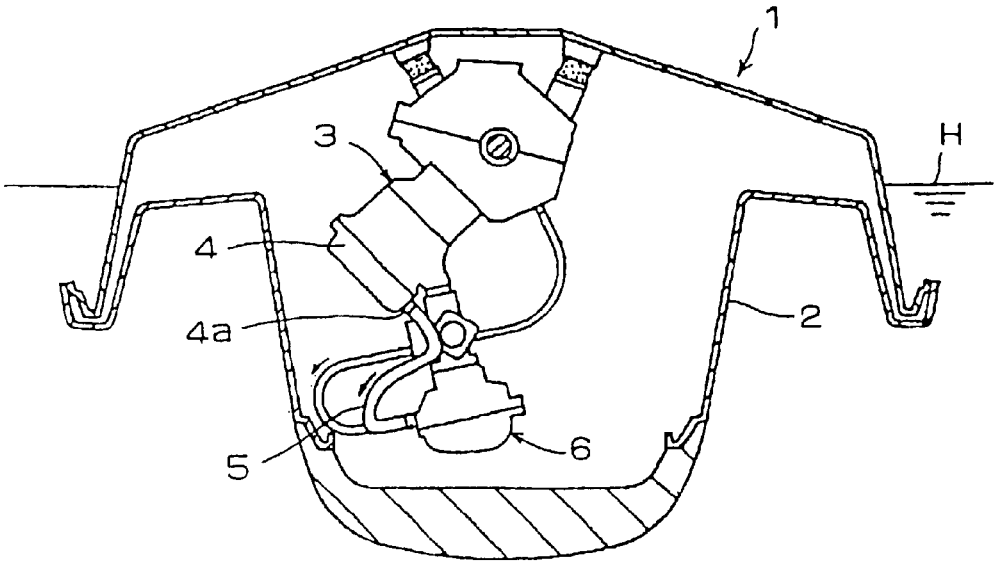

FIG. 8 is a plan view of the cylinder head 22. Referring to FIGS. 8 and 5, a bearing surface 22*b* is provided for the ignition plug P, and the bearing surface 22*b* is inclined as viewed from the front of the boat body. In particular, in the present embodiment, when the engine 20 is carried on the boat body 11, the bearing surface 22*b* is inclined leftwardly in FIG. 3 and downwardly to this side in FIG. 5, and a water drain flow path 22*c* (refer to FIG. 8) is formed at a lowermost end portion of the inclined bearing surface 22*b*. The water drain flow path 22*c* is a through-hole for allowing water around the bearing surface 22*b* to escape therethrough and is formed downwardly in the inclination direction of the bearing surface 22*b* (leftwardly in FIG. 3 and downwardly in FIG. 8). Further, the water drain flow path 22*c* is provided on the downstream side of the plug mounting-dismounting hole 44 described above and the plug bearing surface 22*b* with respect to the turning direction (direction indicated by an arrow mark A in FIG. 7) when the boat is turned back after the boat has capsized.

With the saddle type small-sized boat 10 having such a structure as described above, the following operation and effects are achieved. The head cover 40 of the saddle type small-sized boat 10 with the four-cycle engine 20 having the head cover 40 in which the breather exit 41 is formed is carried in the boat body 11 and forms an oil storage portion when the boat is capsized (refer to FIG. 7). The oil O flowing downwardly (toward the head cover 40) when the boat 10 is capsized is stored by the head cover 40.

Since the upper face 43 of the head cover 40 is positioned close to the ceiling 11*a* of the boat body 11 and extends along the ceiling 11*a,* the containing capacity of the head cover 40 can be increased, and the stored amount of the oil O by the head cover 40 is ensured.

Further, since the breather exit 41 is provided above the upper face O1 of the oil O stored in the head cover 40 when the boat is capsized, the flowing out of the oil O through the breather exit 41 is less likely to occur.

Accordingly, with the saddle type small-sized boat 10, a situation wherein the oil O flows out from the head cover 40 when the saddle type small-sized boat 10 is capsized is less likely to occur. As a result, an advantage is achieved in that the intake apparatus 50 and the inside of the boat body 11 are less likely to be contaminated with the oil O.

Besides, since the containing capacity of the head cover 40 can be increased, the breathing performance is augmented.

In other words, with the present saddle type small-sized boat 10, an effect that a situation that the oil O flows out is less likely to occur and simultaneously the breathing performance is augmented.

Since the breather exit 41 is connected to the intake apparatus 50 by the breather pipe 42, blowby gas leaking out into the head cover 40 is allowed to flow back and be burnt.

Further, since the connection portion 51 of the intake apparatus 50 to the breather pipe 42 is positioned below the breather exit 41, when the boat 10 is capsized as shown in FIG. 7, the connection portion 51 of the intake apparatus 50 to the breather pipe is positioned above the breather exit 41.

Accordingly, when the boat 10 is capsized, the oil O is less likely to flow from the breather exit 41 of the head cover 40 to the intake apparatus 50, and as a result, an effect wherein the intake apparatus 50 and the inside of the boat body 11 are less likely to be contaminated with the oil O is attained.

Since the breather exit 41 is provided on the upstream side with respect to the turning direction A when the boat is turned back after the boat has capsized, a situation wherein the oil O flows out through the breather exit 41 when the boat is turned back after the boat has capsized does not occur.

Accordingly, when the boat is turned back after the boat has capsized, the intake apparatus 50 and the inside of the boat body 11 are prevented from being contaminated with the oil O.

The head cover 40 includes therein the water drain path 46 which is connected to the plug mounting-dismounting hole 44 and is opened to the peripheral face 45 of the head cover 40 rearwardly of the hole 44 with respect to the advancing direction F of the boat body 11. Thus, water is less liable to stay in the plug mounting-dismounting hole 44 in the head cover 40.

In particular, the saddle type small-sized boat of this type is inclined during running thereof such that the forward portion thereof in the advancing direction F is directed upwardly (the rear portion is directed downwardly).

With the present saddle type small-sized boat 10, since the water drain path 46 is connected to the plug mounting-dismounting hole 44 and is opened to the peripheral face 45 of the head cover 40 rearwardly of the hole with respect to the advancing direction F of the boat body 11, water is less liable to stay in the plug mounting-dismounting hole 44. Accordingly, an electric apparatus is less likely to suffer from any trouble.

Since the water drain path 46 of the head cover 40 extends to the rear of the cam cover portion 43*a* of the head cover 40 which covers the cam portions of the camshafts and is opened (46*a*) to the peripheral face 45 of the head cover 40, the water drain path 46 of the DOHC engine 20 which has the intake and exhaust camshafts independent of each other can be formed efficiently (while assuring the containing capacity of the head cover 40).

Since the upper face 22*a* of the cylinder head 22 of the engine 20 is inclined as viewed from the front of the boat body and the water drain path 46 is opened (46*a*) downwardly in the inclination direction of the upper face 22*a,* water is much less likely to stay in the plug mounting-dismounting hole 44, and accordingly, an electric apparatus is much less likely to suffer from any trouble.

Since the water drain path 46 is opened (46*a*) toward the downstream side of the plug mounting-dismounting hole 44 with respect to the turning direction A when the boat is turned back after the boat has capsized, water is much less likely to stay in the plug mounting-dismounting hole 44, and accordingly, an electric apparatus is much less likely to suffer from any trouble.

In particular, when the boat 10 is turned back by the user after the boat has capsized, a large amount of water sometimes splashes on the head cover 40. With the saddle type small-sized boat 10, however, since the water drain path 46 is opened toward the downstream side of the plug mounting-dismounting hole 44 with respect to the turning direction A when the boat is turned back after the boat has capsized, even if a large amount of water splashes on the head cover 40 in the process wherein the boat 10 is turned back the water is discharged with certainty from the plug mounting-dismounting hole 44 past the water drain path 46.

Accordingly, when the boat is turned back after the boat has capsized, water is less likely to stay in the plug mounting-dismounting hole 44, and accordingly, an electric apparatus is less likely to suffer from any trouble.

Since the water drain flow path 22*c* is formed at the lowermost end portions of the plug mounting-dismounting hole 44 and the plug bearing surface 22*b* of the saddle type small-sized boat 10 wherein the engine 20 having the plug mounting-dismounting hole 44 and the plug bearing surface 22*b* which are inclined as viewed from the front of the boat body is carried in the boat body 11, water does not stay around the plug mounting-dismounting hole 44 and the plug bearing surface 22*b,* and an electric apparatus is less likely to suffer from any trouble.

Since the water drain flow path 22*c* is provided on the downstream side of the plug mounting-dismounting hole 44 and the plug bearing surface 22*b* with respect to the turning direction A when the boat is turned back after the boat has capsized, even if a large amount of water splashes around the plug mounting-dismounting hole 44 and the plug bearing surface 22*b* in the process wherein the boat 10 is turned back, the water is discharged with certainty past the water drain flow path 22*c.*

Accordingly, water is less liable to stay around the plug mounting-dismounting hole 44 and the plug bearing surface 22*b* after the boat is turned back after the boat has capsized, and accordingly, an electric apparatus is less likely to suffer from any trouble.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A small-sized boat having a four-cycle engine carried in a boat body comprising:

a head cover in which a breather exit is formed, said head cover forms an oil storage portion when said boat is capsized and is configured such that an upper face of said head cover is positioned close to a ceiling of said boat body and extends along said ceiling, and said breather exit is provided above an upper face of oil stored in said head cover when said boat is capsized.

2. A small-sized boat having a four-cycle engine carried in a boat body according to claim 1, wherein said breather exit is connected to an intake apparatus by a breather pipe, and a connection portion of said breather pipe to said intake apparatus is positioned below said breather exit.

3. A small-sized boat according to claim 1, wherein said breather exit is provided on an upstream side with respect to a turning direction when said boat is turned back after the boat has capsized.

4. A small-sized boat according to claim 2, wherein said breather exit is provided on an upstream side with respect to a turning direction when said boat is turned back after the boat has capsized.

5. A small-sized boat having a four-cycle engine carried in a boat body comprising:

a head cover in which a plug mounting-dismounting hole is formed, said head cover has a water drain path formed therein which connects to said plug mounting-dismounting hole and is opened to a peripheral face of said head cover rearwardly of said hole with respect to an advancing direction of said boat body.

6. A small-sized boat according to claim 5, wherein said four-cycle engine is a DOHC engine having intake and exhaust camshafts independent of each other, and said water drain path of said head cover extends in the rear of a cam cover portion of said head cover which covers cam portions of said camshafts with respect to the advancing direction of said boat body and is opened to a peripheral face of said head cover.

7. A small-sized boat according to claim 5, wherein an upper face of a cylinder head of said engine is inclined as viewed from the front of said boat body, and said water drain path is opened downwardly in a direction of the inclination.

8. A small-sized boat according to claim 6, wherein an upper face of a cylinder head of said engine is inclined as viewed from the front of said boat body, and said water drain path is opened downwardly in a direction of the inclination.

9. A small-sized boat according to claim 7, wherein said water drain path is opened to a downstream side of said plug mounting-dismounting hole with respect to a turning direction when said boat body is turned back after the boat has capsized.

10. A small-sized boat wherein an engine having a plug mounting-dismounting hole and a plug bearing surface which are inclined as viewed from the front of a boat body comprising:

a water drain flow path is formed at lowermost end portions of said plug mounting-dismounting hole and said plug bearing surface.

11. A small-sized boat according to claim 10, wherein said water drain flow path is provided on the downstream side of said plug mounting-dismounting hole and said plug bearing surface with respect to a turning direction when said boat is turned back after the boat has capsized.

12. A small-sized boat having an engine comprising:

a head cover for covering said engine;

a breather exit formed in said head cover;

said head cover forming an oil storage portion when said boat is capsized wherein an upper face of said head cover is positioned close to a ceiling of a boat body and extends along said ceiling, and said breather exit is provided above an upper face of oil stored in said head cover when said boat is capsized.

13. A small-sized boat having an engine according to claim 12, wherein said breather exit is connected to an intake apparatus by a breather pipe, and a connection portion of said breather pipe to said intake apparatus is positioned below said breather exit.

14. A small-sized boat according to claim 12, wherein said breather exit is provided on an upstream side with respect to a turning direction when said boat is turned back after the boat has capsized.

15. A small-sized boat according to claim 13, wherein said breather exit is provided on an upstream side with respect to a turning direction when said boat is turned back after the boat has capsized.

16. A small-sized boat having an engine comprising:

a head cover for covering said engine;

a plug mounting-dismounting hole formed in said head cover;

said head cover including a water drain path formed therein which connects to said plug mounting-dismounting hole and is opened to a peripheral face of said head cover rearwardly of said hole with respect to an advancing direction of said boat body.

17. A small-sized boat according to claim 16, wherein said four-cycle engine is a DOHC engine having intake and exhaust camshafts independent of each other, and said water drain path of said head cover extends in the rear of a cam cover portion of said head cover which covers cam portions of said camshafts with respect to the advancing direction of said boat body and is opened to a peripheral face of said head cover.

18. A small-sized boat according to claim 16, wherein an upper face of a cylinder head of said engine is inclined as viewed from the front of said boat body, and said water drain path is opened downwardly in a direction of the inclination.

19. A small-sized boat according to claim 17, wherein an upper face of a cylinder head of said engine is inclined as viewed from the front of said boat body, and said water drain path is opened downwardly in a direction of the inclination.

20. A small-sized boat according to claim 18, wherein said water drain path is opened to a downstream side of said plug mounting-dismounting hole with respect to a turning direction when said boat body is turned back after the boat has capsized.

* * * * *